US006011936A

United States Patent [19]

Kaneko

[11] Patent Number: 6,011,936

[45] **Date of Patent: *Jan. 4, 2000**

[54] IMAGE FORMING APPARATUS HAVING RECOVERY PROCESS FOR JAMMED SHEETS

[75] Inventor: Tokuharu Kaneko, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/645,564

[22] Filed: May 14, 1996

[30] Foreign Application Priority Data

| | | | |
|---|---|---|---|
| May 16, 1995 | [JP] | Japan | 7-117376 |
| Jun. 1, 1995 | [JP] | Japan | 7-134970 |
| May 7, 1996 | [JP] | Japan | 8-112317 |

[51] Int. Cl.[7] ..... G03G 15/00

[52] U.S. Cl. ..... 399/21; 399/124

[58] Field of Search ..... 399/18–21, 124, 399/11

[56] References Cited

U.S. PATENT DOCUMENTS

| | | | |
|---|---|---|---|
| 4,497,569 | 2/1985 | Booth, Sr. | 399/20 |
| 4,627,711 | 12/1986 | Schron | 399/20 |
| 4,750,020 | 6/1988 | Ishizu et al. | 399/20 |
| 4,908,655 | 3/1990 | Takagi | 355/50 |
| 5,079,598 | 1/1992 | Kaneko et al. . | |
| 5,192,977 | 3/1993 | Kaneko et al. . | |
| 5,257,070 | 10/1993 | Miller et al. | 399/20 |
| 5,328,168 | 7/1994 | Fox | 271/259 |
| 5,517,281 | 5/1996 | Miyashiro et al. | 355/50 |

FOREIGN PATENT DOCUMENTS

| | | |
|---|---|---|
| 0 106 567 | 4/1984 | European Pat. Off. . |
| 58-152264 | 9/1983 | Japan . |
| 1-226650 | 9/1989 | Japan . |
| 2-132037 | 5/1990 | Japan . |
| 2-169434 | 6/1990 | Japan . |

*Primary Examiner*—Robert Beatty

*Attorney, Agent, or Firm*—Fitzpatrick, Cella, Harper & Scinto

[57] ABSTRACT

The present invention aims to provide a sheet conveying apparatus and an image forming apparatus having such a sheet conveying apparatus. If a sheet is jammed, the sheet is stopped in a sheet convey path at a position where the sheet can easily be removed by optimum treatment procedure. Sensors are disposed in a sheet convey path constituted by a plurality of units of an image forming apparatus portion and a sheet is stopped at an optimum position by a sheet position counter for recognizing the present position of the sheet in the sheet convey path.

14 Claims, 13 Drawing Sheets

SHEET SUPPLY TASK
S201
PASSED SENSOR ?
NO
YES
S202
C = Ca
S203
ON/OFF CONVEY DRIVE SYSTEM
S204
NO
JAM OCCURRED ?
YES
S205
CALCULATE UNIT NO. FROM Cx
S206
Cd = Cs − Cx
S207
Cd − 1 = 0 ?
NO
YES
S208
OFF CONVEY DRIVE SYSTEM
S209
SUCCEEDING SHEET EXISTED ?
NO
YES
S210
ALARM JAM OF SUCCEEDING SHEET
S211
Cx > Ci ?
NO
YES
S212
START POST-ROTATION OF HIGH PRESSURE
TO NEXT TASK

IMAGE FORMING APPARATUS HAVING RECOVERY PROCESS FOR JAMMED SHEETS

BACKGROUND OF THE INVENTION

1. Field of the Invention

The present invention relates to a sheet treatment in an image forming apparatus such as a copying machine, a printer, a facsimile and the like.

2. Related Background Art

In the past, if a sheet is jammed on the way, clutches and motor for transmitting a driving force to a convey system are stopped immediately. The sheet stopped in a convey path is detected by a sensor for detecting the passage of the sheet, and a convey path unit including the sensor is displayed on a display.

In order to improve the removal of the jammed sheet, techniques in which a sheet convey path is divided into a plurality of units which can be removably mounted on a main body of an image forming apparatus has recently been proposed.

However, in the image forming apparatus having the plurality of units which can be removably mounted on the image forming apparatus as mentioned above, if the sheet is jammed when the convey drive system is stopped immediately, there is the danger of stopping the single sheet in two adjacent units. In such a case, if one of the units is drawn out, the jammed sheet will be torn. Further, as the sheet size becomes smaller, since the sheet convey path is curved more complicatedly, it is difficult to remove the jammed sheet.

SUMMARY OF THE INVENTION

The present invention aims to eliminate the above-mentioned conventional drawbacks, and has an object to provide a sheet conveying apparatus and an image forming apparatus having such a sheet conveying apparatus, in which, if a sheet is jammed, the jammed sheet is stopped at a position (in a sheet convey path) where the sheet can easily be removed, and the optimum treatment procedure can be displayed.

To achieve the above object, a sheet conveying apparatus according to the present invention comprises a sheet convey means for conveying a sheet, a sheet detection means for detecting the passage of the sheet in a sheet convey path within which the convey means is disposed, a convey abnormality detecting means for detecting the abnormality in sheet conveyance in the sheet convey path, a sheet position counter for recognizing a position of the sheet in the sheet convey path, a sheet stop position determining means for determining a optimum stop position of the sheet on the basis of the sheet position counter, when the abnormality in sheet conveyance is detected by the convey abnormality detecting means, and a stop control means for stopping the sheet at the stop position determined by the sheet stop position determining means.

Further, the stop control means serves to successively stop sheets situated at an upstream side of the stopped sheet (stopped in the sheet convey path) in a sheet conveying direction after the sheet (having the convey abnormality) was stopped. In addition, sheet position counter serves to recognize a tip end of the sheet. The sheet position counter may be renewed to a predetermined count value when the sheet passes through the sheet detection means.

Further, a sheet conveying apparatus according to the present invention may comprise a sheet convey means for conveying a sheet, a sheet detection means for detecting the passage of the sheet in a sheet convey path within which the convey means is disposed, a convey abnormality detecting means for detecting the abnormality in sheet conveyance in the sheet convey path, a unit open/close detection means for detecting the fact that a first openable unit constituting a part of the sheet convey path is opened, a unit mount/dismount detection means for detecting the fact that a second removable unit constituting a part of the sheet convey path is mounted or dismounted, a display means for displaying a treatment procedure of the apparatus, a unit recognizing means for recognizing or identifying the unit including the sheet when the abnormality in sheet conveyance is detected by the convey abnormality detecting means, a display order determining means for determining the display order of the unit (to be treated) identified by the unit recognizing means, and a display control means for causing the display means to display the treatment procedure in the order determined by the display order determining means.

An image forming apparatus according to the present invention includes the above-mentioned sheet conveying apparatus and comprises an image forming means for forming an image on the sheet conveyed by the sheet conveying apparatus in response to image information, a temporary contain means for temporarily containing the sheet on which the image was formed by the image forming means, and a display control means for causing the display means to display the fact that the sheet in the temporary contain means, when the temporary contain means is mounted in a condition that the available sheet remains in the temporary contain means, after the abnormality in sheet conveyance is detected by the convey abnormality detecting means.

With the arrangement as mentioned above, in the sheet conveying apparatus according to the present invention, if the abnormality in sheet conveyance is detected by the convey abnormality detecting means, the present position of the sheet is recognized by the sheet position counter indicating the absolute position of the sheet in the sheet convey path, and the optimum stop position of the sheet is determined by the sheet stop position determining means. Then, the stop control means stops the sheet at the stop position determined by the sheet stop position determining means. In this way, the sheet can be stopped at the optimum stop position.

Further, if the abnormality in sheet conveyance is detected by the convey abnormality detecting means, the unit including the sheet having abnormality is recognized or identified by the unit recognizing means, and the display order of the unit to be treated is determined by the display order determining means. Then, the display control means causes the display means to display the treatment procedure in the order determined by the display order determining means. In this way, the position of the unit including the stopped sheet can surely be recognized, and the jam treatment can be effected efficiently in accordance with the priority order.

In addition, in the image forming apparatus according to the present invention, by utilizing the advantages of the sheet conveying apparatus, the image can be formed on the sheet effectively.

DETAILED DESCRIPTION OF THE PREFERRED EMBODIMENTS

Now, the present invention will be concretely explained. As an example of an image forming apparatus having a sheet conveying apparatus according to the present invention, an electrophotographic copying machine will be described.

Figure 1:
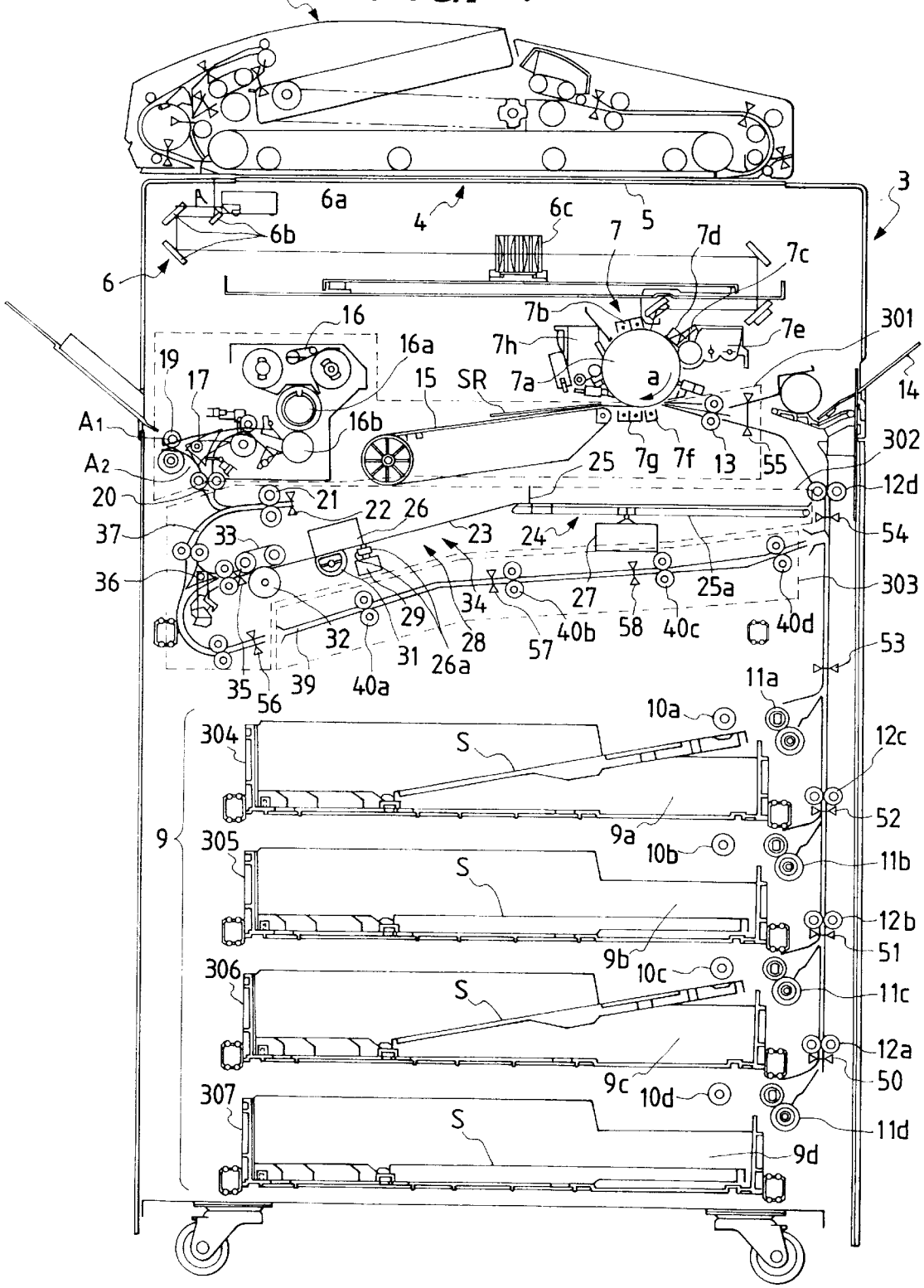
FIG. 1 is a schematic elevational sectional view of a copying machine having a sheet conveying apparatus according to a preferred embodiment of the present invention.

In FIG. 1, the copying machine 1 includes a circulating automatic original feeding apparatus (RDF) 2 and an image forming apparatus portion 3. The automatic original feeding apparatus 2 can be combined with the image forming apparatus portion 3 appropriately.

The image forming apparatus portion 3 has an upper original support glass (original resting plate) 5 below which there is provided an optical system (image reading means) 6. The optical system 6 includes an exposure lamp (original illumination lamp) 6*a*, a scan mirror 6*b*, a zoom lens 6*c* and a motor (not shown) so that an original is illuminated by the exposure lamp 6*a* and light reflected from the original is incident to a photosensitive drum 7*a* through the scan mirror 6*b* and the zoom lens 6*c*.

In order to direct the light reflected from the original to the photosensitive drum 7*a*, a method for shifting the optical system 6 such as the exposure lamp 6*a* while maintaining the original on the original support glass 5 or a method for shifting the original on the original support glass 5 while fixing the optical system 6 such as the exposure lamp 6*a* (flow reading mode) can be adopted.

Below the optical system 6, there is provided an image forming portion (image forming means) 7 which includes the above-mentioned photosensitive drum 7*a* rotated in a direction shown by the arrow a, a high voltage unit 7*b*, a blank exposure unit 7*c*, a potential sensor 7*d*, a developing device 7*e*, a transfer charger 7*f*, a separation charger 7*g* and a cleaning device 7*h*. These elements 7*b* to 7*h* are disposed around the photosensitive drum 7*a*. The photosensitive drum 7*a* is rotated by a main motor (not shown); meanwhile, after the photosensitive drum is corona-charged by the high voltage unit 7*b*, the light reflected from the original is illuminated on the photosensitive drum through the optical system 6, thereby forming an electrostatic latent image on the drum. Then, the electrostatic latent image is developed by the developing device 7*e* to be visualized as a toner image.

On the other hand, at a lower portion of the image forming apparatus portion 3, there are disposed a sheet supply cassette portion 9 including a first stage cassette 9*a*, a second stage cassette 9*b*, a third stage cassette 9*c* and a fourth stage cassette 9*d*. The cassette 9*a* to 9*d* are associated with sheet supply means 10*a* to 10*d* and 11*a* to lid for feeding out sheets (contained in the cassette 9*a* to 9*d*) from the cassette 9*a* to 9*d*. Now, as an example, the sheet supply means associated with the third stage cassette 9*c* will be described. (The sheet supply means associated with the other cassettes have the same construction.)

A pick-up roller 10*c* for feeding out the sheet(s) S from the cassette 9*c* is disposed above a sheet supply outlet of the cassette 9*c*, and a pair of separation rollers 11*c* comprised of a supply roller and a retract roller are disposed at a downstream side of the cassette 9*c* to separate and supply the sheet(s) fed out by the pick-up roller 10*c* one by one. In this way, a lowermost sheet S alone is separated from the other sheet(s) by the pair of separation rollers 11*c*. The separated sheet S is sent to a pair of regist rollers 13 disposed in front of the image forming portion 7 by means of a sheet convey means including pairs of convey rollers 12*a*, 12*b*, 12*c* and 12*d*.

Further, in the vicinity of the image forming portion 7, there is provided a multi manual insertion device 14 for conveying a sheet to the image forming portion 7 by manually inserting the sheet. At a downstream side of the image forming portion 7, there is provided a convey belt 15 for conveying the sheet (on which the image was formed) toward a downstream side. A fixing device 16 for fixing the toner image to the sheet S with heat is disposed at a downstream side of the convey belt 15. At a downstream side and in the vicinity of the fixing device 16, there is disposed a discharge flapper 17 for switching or selecting a discharge path A1 for discharging the sheet from the fixing device 16 out of the image forming apparatus portion 3 and a re-convey path A2 used in a sheet both-face recording mode or a sheet multi recording mode. And, a pair of discharge rollers 19 are disposed in the discharge path A1.

Below the fixing device 16, there is provided a convey path 20 connected to the re-convey path A2, and, at a downstream side of the convey path 20, there are disposed a pair of temporary contain tray discharge rollers 21 for discharging the sheet S into a temporary contain tray 23 for temporarily containing the imaged sheets S, and a discharge sensor 22 for detecting the sheet S discharged to the temporary contain tray 23. Incidentally, the discharge sensor 22 acts as both a sheet detection means for detecting the passage of the sheet S and a convey abnormality detecting means for detecting the abnormality in sheet conveyance. In the vicinity of the discharge sensor 22, a re-supply device 34 for successively re-supplying the sheets S contained in the temporary contain tray 23.

In order that the temporary contain tray 23 helps to bring the sheet S to a re-supply separation belt 33 when the sheet S is re-supplied from the tray, as shown in FIG. 1, the temporary contain tray 23 is inclined at a predetermined angle, and a sheet re-supply roller 31 for re-supplying the sheet S is disposed in the vicinity of an outlet of the temporary contain tray 23. At a down stream side of the sheet re-supply roller 31, a re-supply feed roller 32 is urged against the re-supply separation belt 33 so that the sheets S can be separated and re-supplied one by one.

A multi flapper 36 is disposed at a downstream side and in the vicinity of the re-supply feed roller 32 and the re-supply separation belt 33, and, at a downstream side of the flapper 36, there are disposed an upwardly extending reverse rotation convey path 37 for reversely rotating (turning over) the imaged surface of the sheet S once so that images can be formed on the imaged surface of the sheet in a superimposed fashion in the multi recording mode, and a downwardly extending convey path 39 for reversely rotating the imaged surface of the sheet S so that an image can be formed on the other surface of the sheet S in the both-face recording mode. Depending upon the recording mode, by switching the multi flapper 36, the sheet S can be introduced into the reverse rotation convey path 37 or the convey path 39.

The convey path 39 includes pairs of convey rollers 40*a*, 40*b*, 40*c* and 40*d*. Further, sensors 51, 52, 53, 54, 55, 56, 57 and 58 each acting as a sheet detection means for detecting the passage of the sheet S in the sheet convey path and a convey abnormality detecting means for detecting the abnormality in the sheet conveyance are disposed at predetermined positions in the sheet convey paths of the sheet convey means included in the image forming apparatus portion 3.

Figure 2:
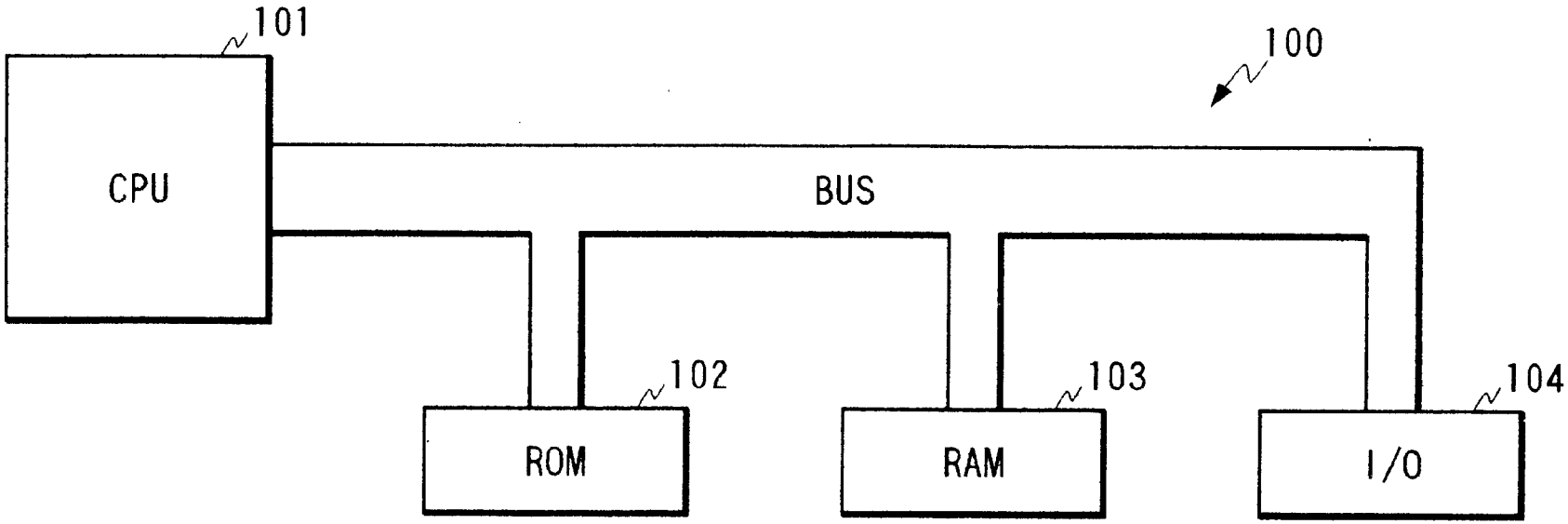
FIG. 2 is a block diagram of a control device of the copying machine having the sheet conveying apparatus according to the present invention.

FIG. 2 is a block diagram of a control device 100 of the copying machine having the sheet conveying apparatus according to the present invention. The control device 100 includes a CPU 101 for controlling the entire copying machine 1 in accordance with the control sequence (control program) stored in a ROM (read only memory) 102, the above-mentioned ROM 102 for storing the control program, a RAM (random access memory) 103 acting as a main memory for storing input data and used as a work area, and an I/O (input/output processor) 104 for outputting a control signal of the CPU 101 for the drive means such as the main motor and for receiving signals from the sensors and for sending the sensor signals to the CPU 101.

Figure 3:
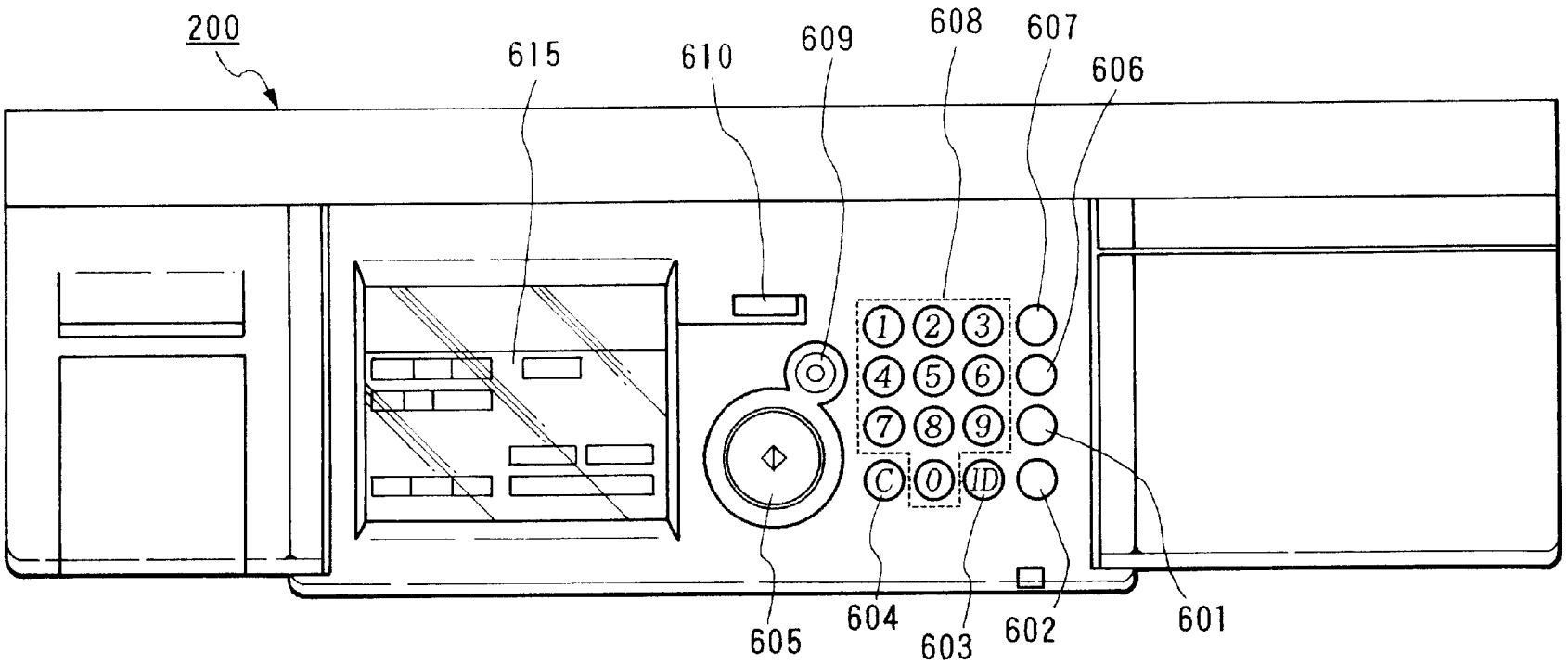
FIG. 3 is a plan view of an operation panel.

FIG. 3 shows an operation panel 200 provided on the image forming apparatus portion 3. A user mode key 601 is used by an operator to perform ON/OFF of auto (automatic) sort, ON/OFF of sheet removal before sorter, ON/OFF of skip both-face, ON/OFF of feeder manual insertion auto start, ON/OFF of cassette auto selection, ON/OFF of buzzer, change to smaller mode, setting of pre-heat mode, initialization of specification, change in standard mode, change in auto clear time, change in auto power off time, setting of weekly timer, setting of day of week/time, zoom fine adjustment, cleaning of feeder, cleaning of wire and the like.

An all reset key 610 is depressed when the standard mode should be restored. A copy start key 605 is depressed when a copying operation is to be started. A clear key 604 is used when the set number of copies is cleared. A stop key 609 is depressed when the continuous copying operation is interrupted, so that, after the copying operation upon depressing this key is finished, the copying operation of the copying machine is stopped.

A ten-key 608 is used when the number of copies is set. A guide key 62 is used to display explanation of functions corresponding to various keys on a message display 615. A pre-heat key 607 is depressed to change to a pre-heat mode and is constituted by a self-illumination key having a light emitting elements such as an LED so that, when the pre-heat mode is selected, this key is illuminated.

An interruption key 606 is depressed when the copying operation is interrupted to perform another copying operation. Similar to the pre-heat key 607, this interruption key 606 is also constituted by a self-illumination key, and, thus, is illuminated when the interruption is effected.

The message display (display means for displaying operation procedure of the machine) 615 has a touch panel of LCD (liquid crystal display) type for displaying information (characters and figures) regarding the copying operation with 240×320 dots. In a standard condition, the message display 615 displays a normal magnification change key, a same magnification key, a zoom key, a smaller key, a sheet selection key, a copy density key, a sorter key for selecting functions of a sorter, a both-face key for setting a mode regarding the both-face copy, and application mode keys for setting copy modes regarding application copies such as frame erase, staple margin, front page/bundle, contraction layout, enlargement layout, OHP sheet insertion between sheets, page sequence copy, multi copy, original mix, photograph, mode memory and the like. By touching a portion of the display corresponding to the specific key, a window regarding the contents of the touched key. Further, the operation sequence is displayed when the sheet jam or error is generated.

FIGS. 4A to 4F are explanatory views for explaining original reading operations in a flow reading mode. First of all, the originals D are set in the automatic original feeding apparatus 2 (see FIG. 4A). When the copy start key 605 is depressed, the automatic original feeding apparatus 2 supplies a lowermost sheet D2 (2) to the original reading portion 4 from right (FIG. 4A), and the image forming apparatus portion 3 shifts the optical system 6 to a center of the original support glass 5. The optical system 6 is then stopped at that position by an optical system locking means (not shown) (see FIG. 4B).

Figure 4A:
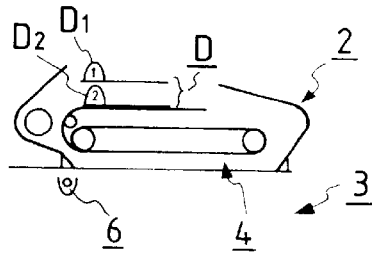
FIGS. 4A to 4F are explanatory views for showing original reading operation in a flow reading mode.
Figure 4B:
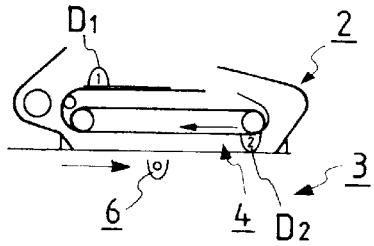
Figure 4C:
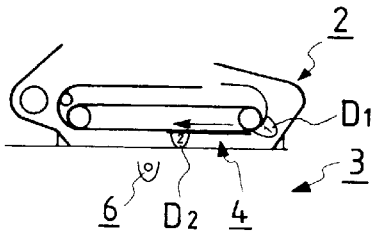
Figure 4D:
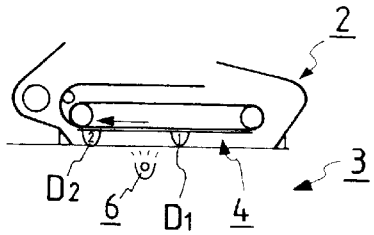
Figure 4E:
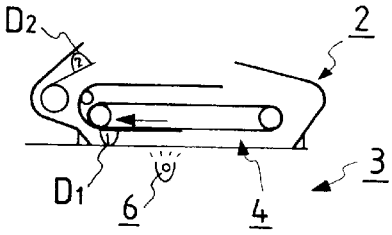
Figure 4F:
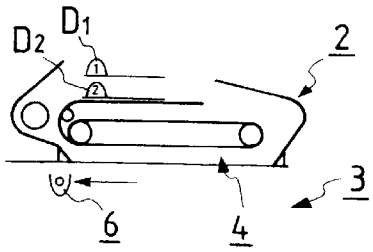

When the lowermost sheet D2 is conveyed in front of the optical system 6 (see FIG. 4C), an image signal is sent from the automatic original feeding apparatus 2 to the image forming apparatus portion 3, with the result that the exposure lamp 6*a* is illuminated and the regist rollers 13 are controlled in response to the image signal (see FIG. 4D). In this case, following to the lowermost sheet, a next sheet D1 (1) which was rested on the lowermost sheet D2 is sent to the original reading portion 4 from right. While the next sheet D1 is being exposed, the lowermost sheet D2 is discharged from left (see FIG. 4E). Then, the optical system 6 is returned to a home position and the next original D1 is discharged from left (see FIG. 4F).

Figure 5:
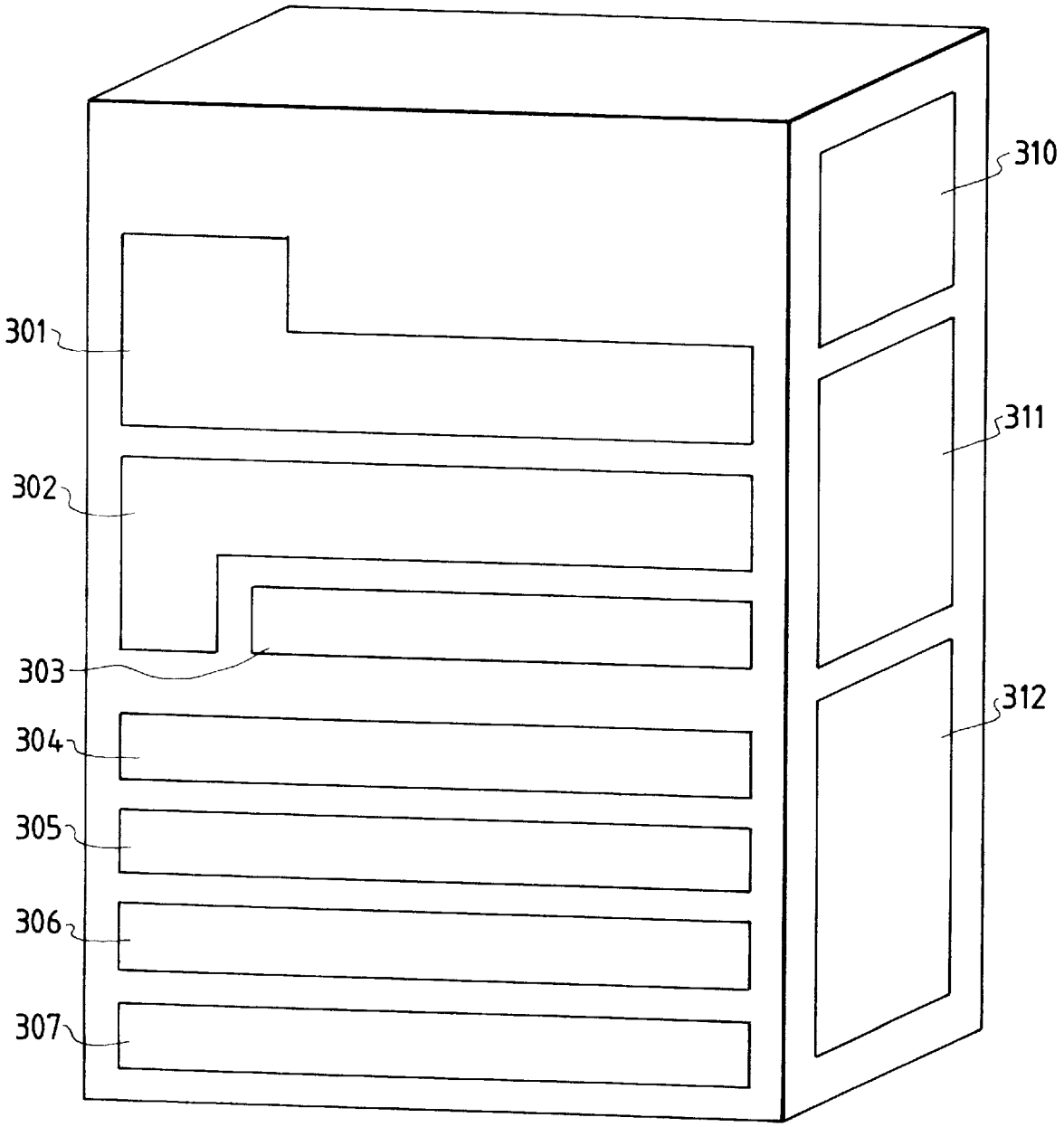
FIG. 5 is a perspective view of removable units and openable units provided in the copying machine.
Figure 6:
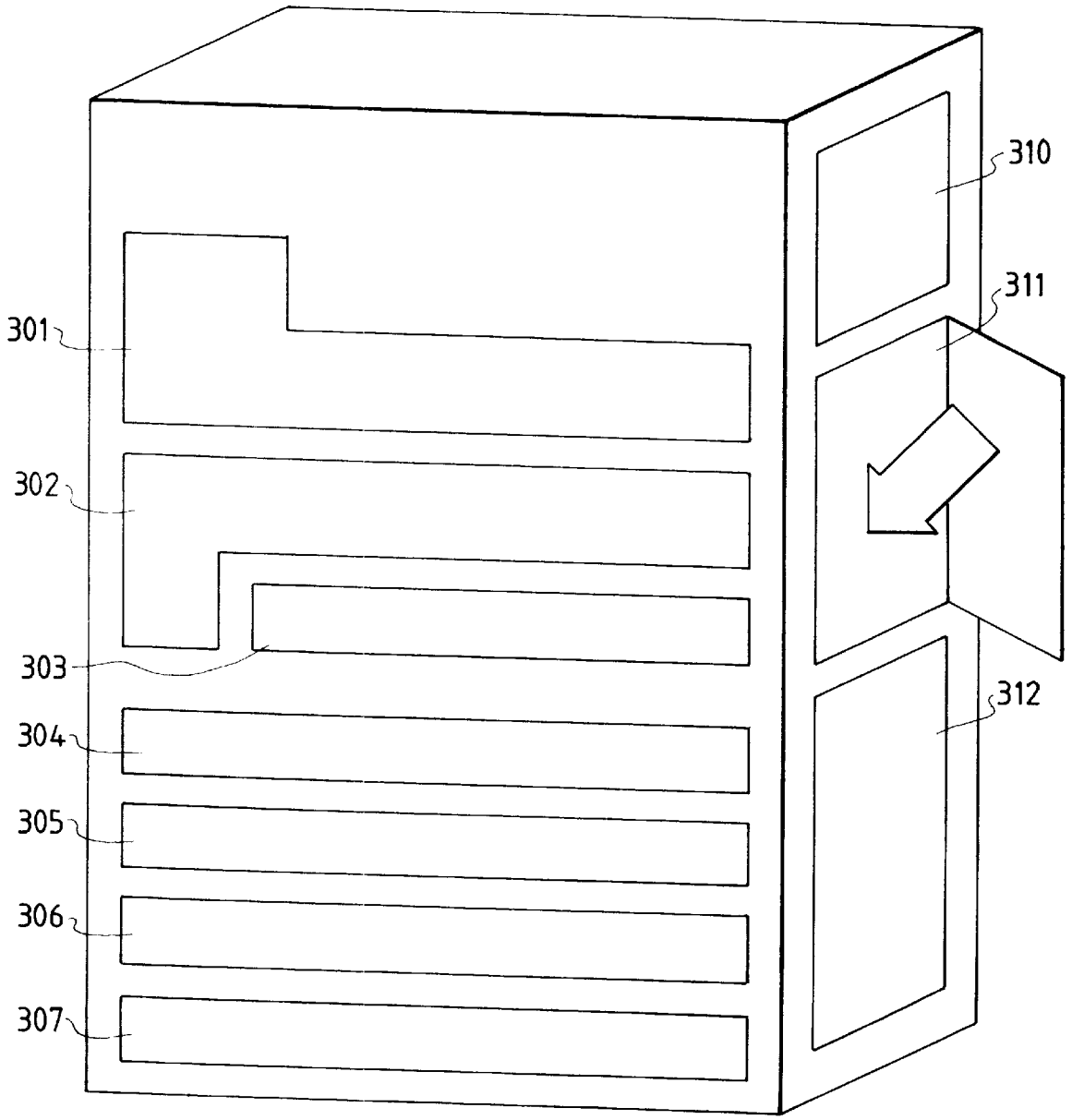
FIG. 6 is a perspective view showing a condition that a right upper door unit is opened.

FIG. 5 is a perspective view showing an example that the sheet convey paths in the image forming apparatus portion 3 are divided into a plurality of units which can be removable or openable with respect to the image forming apparatus portion 3. FIG. 6 is a perspective view showing a condition that a right upper door unit 311 in FIG. 5 is opened and FIG. 7 is a perspective view showing a condition that a fixing convey unit 301 in FIG. 5 is retracted toward a front side and dismounted from the image forming apparatus portion 3.

Figure 7:
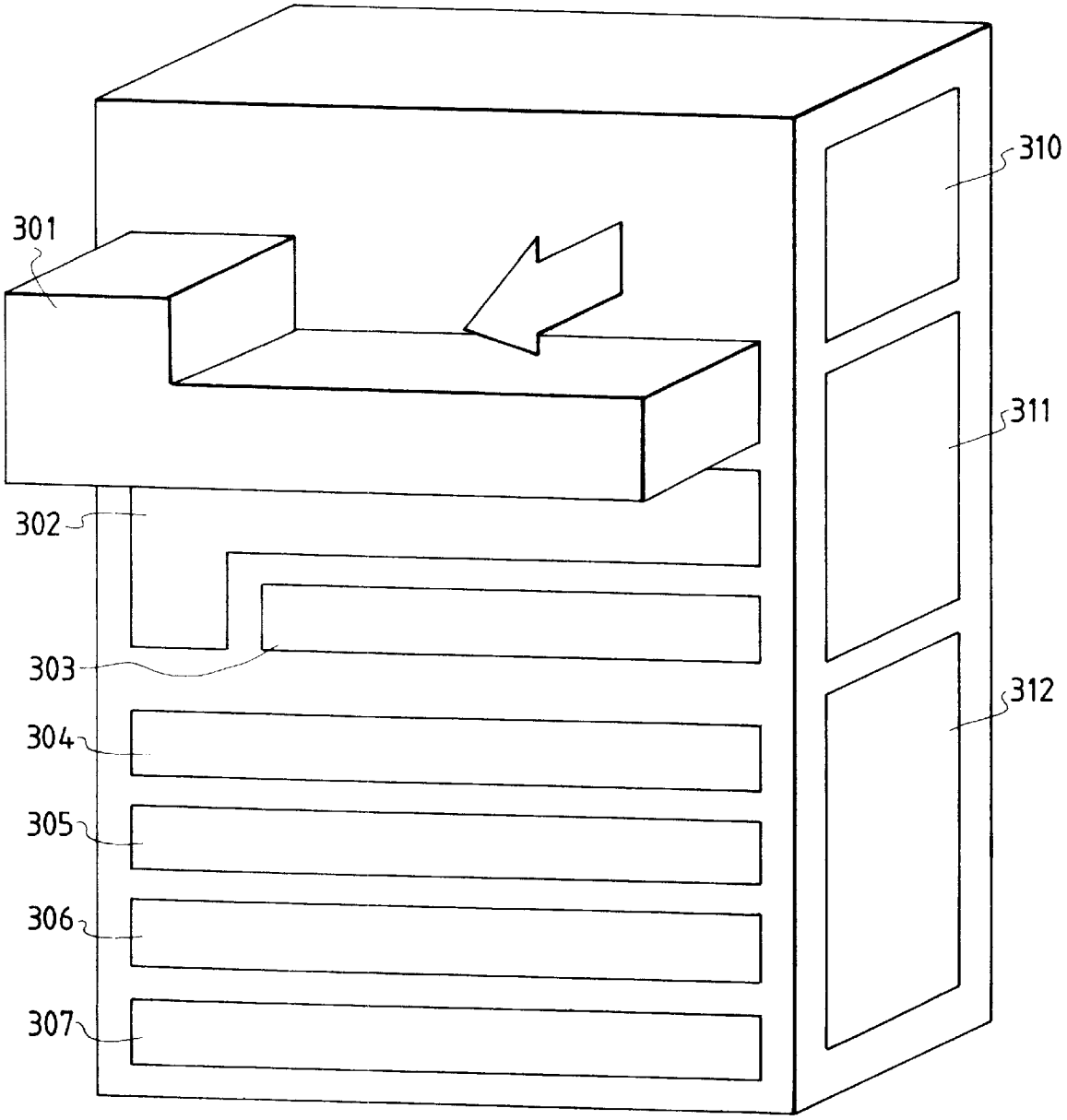
FIG. 7 is a perspective view showing a condition that a fixing convey unit is retracted toward a front side.

In FIGS. 5 to 7, the reference numeral 301 denotes the fixing convey unit including various elements between the regist rollers 13 and the discharge rollers 19; 302 denotes a temporary contain tray unit including the temporary contain tray 23 and the re-supply device 34; 303 denotes a sheet re-supply convey unit including the pairs of convey rollers 40*a* to 40*d* for conveying the sheet S re-supplied from the temporary contain tray 23; and 304, 305, 306 and 307 denote sheet supply cassette units including the first to fourth stage cassettes 9*a*–9*d*, respectively. The units can be retracted toward the front side to be dismounted from the image forming apparatus portion 3.

The reference numeral 310 denotes a manual insertion cover unit including an openable convey path for the multi manual insertion device 14; and 311, 312 denote an openable right upper door unit and an openable right lower door unit, respectively, which are obtained by dividing the vertically extending convey path (of the image forming apparatus portion 3) including the convey rollers 12*a* to 12*d* into two. The manual insertion cover unit 310 and the door units 311, 312 can be opened around their fulcrums disposed at the rear side. As mentioned above, the units which can be dismounted or opened with respect to the image forming apparatus portion 3 are provided with unit dismount detection means (not shown) or unit open detection means (not shown) which can detect the fact that the unit is dismounted or opened. By these detection means, information regarding the dismounting or opening of the unit is transmitted to the control device 100.

Further, the sheet S conveyed through the various units is detected by the sensors 22, 50 to 58. On the basis of the signals from these sensors, the unit to which the sheet actually belongs is recognized or identified by a unit recognizing means of the control device 100. Further, if the abnormality in conveyance of the sheet being conveyed through a certain unit, the unit to which the abnormal sheet actually belongs is recognized, and the abnormal unit is displayed on the message display (LCD) 615 on the operation panel 200, thereby commanding the optimum treatment procedure.

Figure 8:
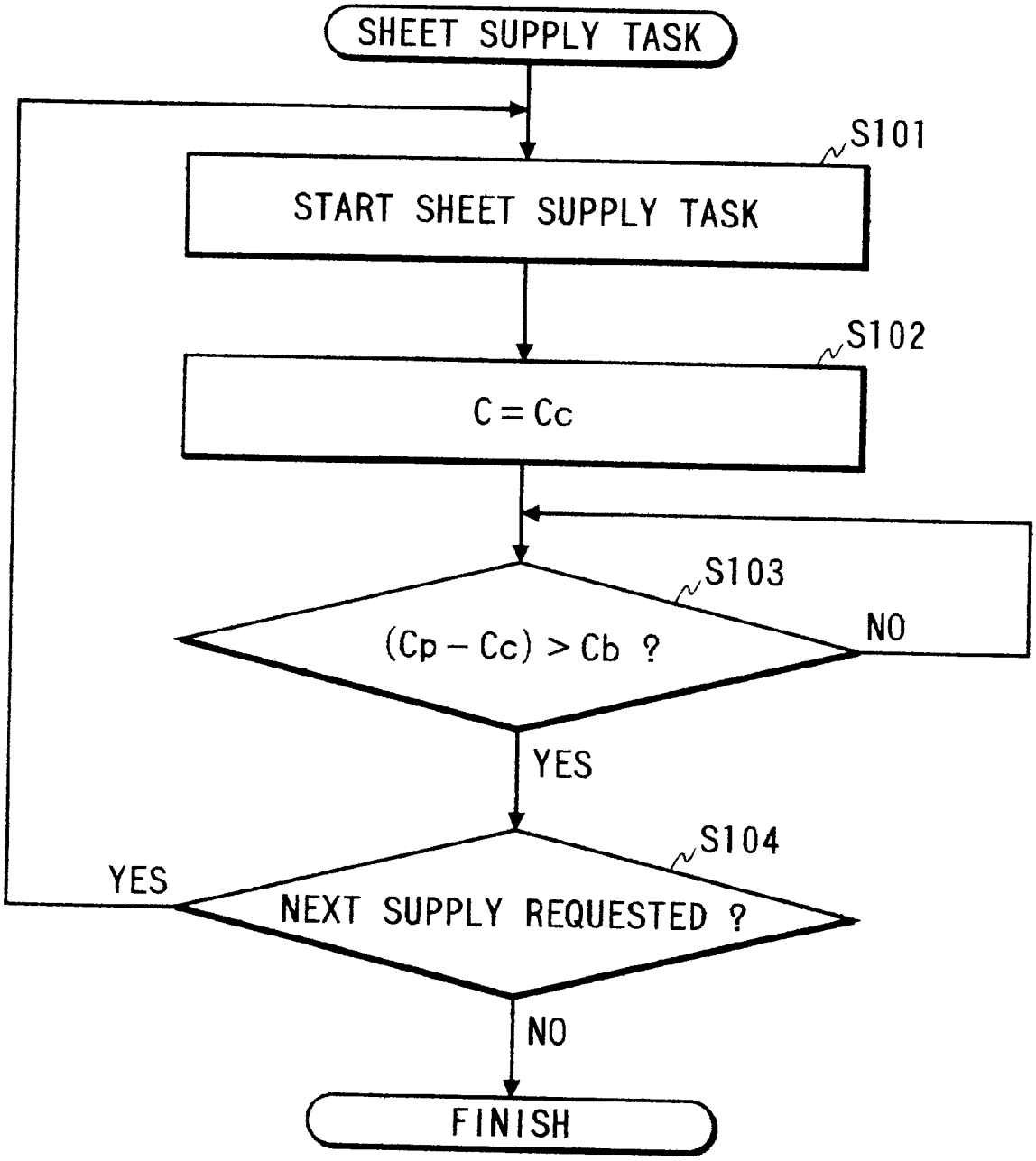
FIG. 8 is a flow chart showing control of sheet supply task.

Next, the control system of the copying machine 1 having the above-mentioned construction will be explained. FIG. 8 is a flow chart showing control task for controlling the sheet supplying operation in the image forming apparatus portion 3. First of all, when the copy start key 605 is depressed, sheet supply task for controlling the conveyance of the sheet S is started (step S101), and a position count value Cc corresponding to a position of each sheet supply cassette unit 304 to 307 in the sheet convey path is set in a position counter C for the sheet supply task (step S102).

The position counter C is a sheet position counter for recognizing the present position of the sheet S in the sheet convey path of the image forming apparatus portion 3, and the counter value is so designed that, regarding the position of the regist roller pair 13 ("0" value in this point), an upstream side (sheet supply side) has a "minus" value and a downstream side (discharge side) has a "plus" value. Further, the position counter C is counted up by an encoder clock of the main motor for driving the convey means such as the convey rollers disposed in the sheet convey path of the image forming apparatus portion 3 or an internal timer clock (not shown), and the count value is subjected to calculation treatment in the control device 100.

In the position counted C counted up by the encoder clock, the count value Cc corresponding to the position of each sheet supply cassette unit 304 to 307 is a value obtained by dividing the actual distance between the position of the sheet supply cassette unit 304 to 307 and the regist roller pair 13 along the convey path by a moving distance corresponding to one (1) pulse of the encoder clock. The position counter C is designed to indicate the value calculated in the manner as mentioned above.

Then, when a value obtained by subtracting the position count value Cc corresponding to the position of the sheet supply cassette unit 304 to 307 from a count value Cp of the position counted C counted in the former sheet supply task control exceeds a count value Cb corresponding to a distance between a preceding sheet and a succeeding sheet along the sheet convey path (step S103), if the supply of a next sheet S is required (step S104), a next sheet supply task is started (step S101); whereas, if the supply of the next sheet S is not required, the sheet supply task is finished.

Figure 9:
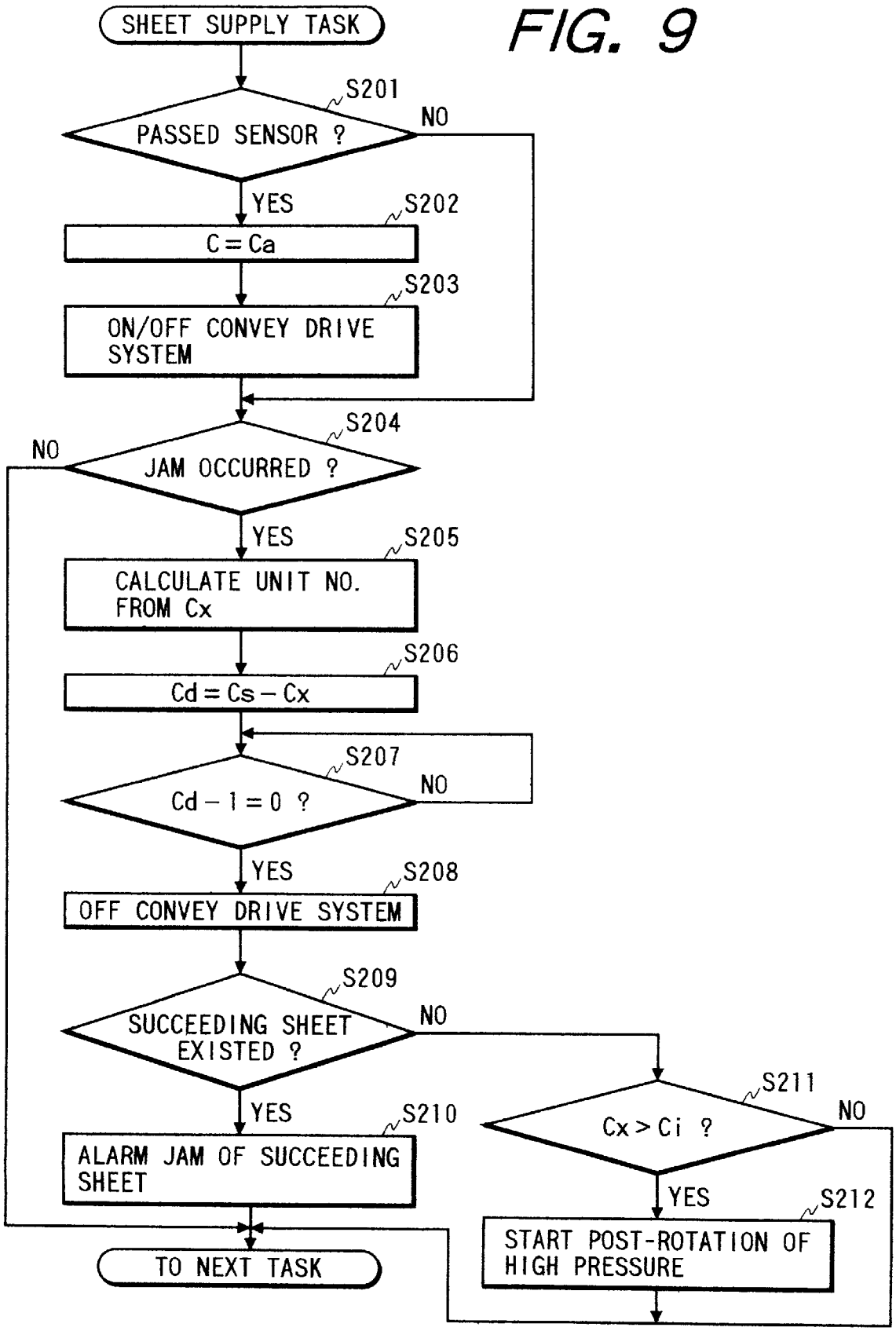
FIG. 9 is a flow chart showing the operation of sheet supply task.

Next, the details of the sheet supply task will be described. FIG. 9 is a flow chart showing the operation of the sheet supply task. First of all, when the sheet supply task is started, the fact that the sheet S passes through either one of the sensors 22, 50 to 58 disposed in the convey path (step S201). After the sheet S passes through a certain sensor, the value of the position counter C is corrected to an absolute position counter value Ca corresponding to the position of the sensor in question (step S202), and then, the convey means (convey rollers in the sheet convey path) to be then driven is turned ON and the convey means through which the sheet has already passed is turned OFF (step S203).

Then, it is judged whether the sheet S is jammed or not by the sensors 22, 50 to 58 (step S204). If the sheet is jammed in the sheet convey path, on the basis of the present count value Cx of the position counter C, the unit to which the jammed sheet belongs is calculated and the jammed unit is selected among the fixing convey unit 301, temporary contain tray unit 302, re-supply convey unit 303, sheet supply cassette units 304 to 307, manual insertion cover unit 310, right upper door unit 311 and right lower door unit 312 (step S205).

On the basis of the count information of the position counter C, the optimum stop position of the sheet S is determined by a sheet stop position determining means of the control device 100, and a stop position count value Cs of the position counter C corresponding to a predetermined optimum position where the sheet S is stopped in the unit in question is outputted. Then, the present count value Cx is subtracted from the stop position count value Cs (step S206). If a difference value Cd (between the values Cs and Cx) is reached (step S207), the convey means (such as the convey rollers) being driven is turned OFF by a stop control means, thereby stopping the sheet S at a desired position (step S208). For example, the sheet immediately in front of the regist roller pair 13 or the sheet being passed in a nip between the regist rollers 13 is stopped in a condition that a trail end portion of the sheet is pinched between the regist rollers 13, as shown in FIG. 1 by SR. In this case, the trail end of the sheet SR is completely included in the fixing convey unit 301 (shown by the broken line), even when the fixing convey unit 301 is retracted toward the front side, the sheet is not torn.

Further, since the sheet SR is stopped in the condition that it is pinched between the regist rollers 13, when the unit 310 is retracted, the sheet SR is surely be retracted together with the unit 301, with the result that the sheet is not trapped on the photosensitive drum 7*a*. Since the trail end portion of the sheet alone is pinched between the regist rollers 13, the sheet SR can easily be removed.

Incidentally, even when the sheet SR has a maximum length among sheets available to the copying machine, by selecting a distance between a pair of fixing rollers 16*a*, 16*b* and the pair of regist rollers 13 so that a tip end is not pinched between the pair of fixing rollers 16*a*, 16*b* when the sheet is stopped at the predetermined position, the jammed sheet can easily be removed.

Further, when the distance between the pair of fixing rollers 16*a*, 16*b* and the pair of regist rollers 13 is short, the pair of fixing rollers 16*a*, 16*b* may be stopped before the tip end of the sheet SR reaches the pair of fixing rollers 16*a*, 16*b*. In this case, when the sheet is stopped at the predetermined position, the sheet SR is bent or curved between the fixing device 16 and the photosensitive drum 7*a*.

Then, it is judged whether a succeeding sheet S exists at the upstream side of the stopped sheet S (step S209). If the succeeding sheet S exists, the jamming of the preceding sheet S is alarmed to the sheet supply task for the succeeding sheet S (step S210); whereas, if the succeeding sheet S does not exist, it is judged whether the present position count value Cx exceeds a count value Ci (of the position counter C) corresponding to a position of the separation charger 7*g* (step S211).

If the present position count value Cx exceeds the count value Ci corresponding to the position of the separation charger 7*g*, post-rotation control of high voltage (in which the first charge, developing bias, post charge, transfer charge and separation charge are successively turned OFF) is started (step S212), and the program goes to a next task. Then, the sheet supply task is finished. The next task is started after a predetermined time is elapsed, if necessary.

Figure 10:
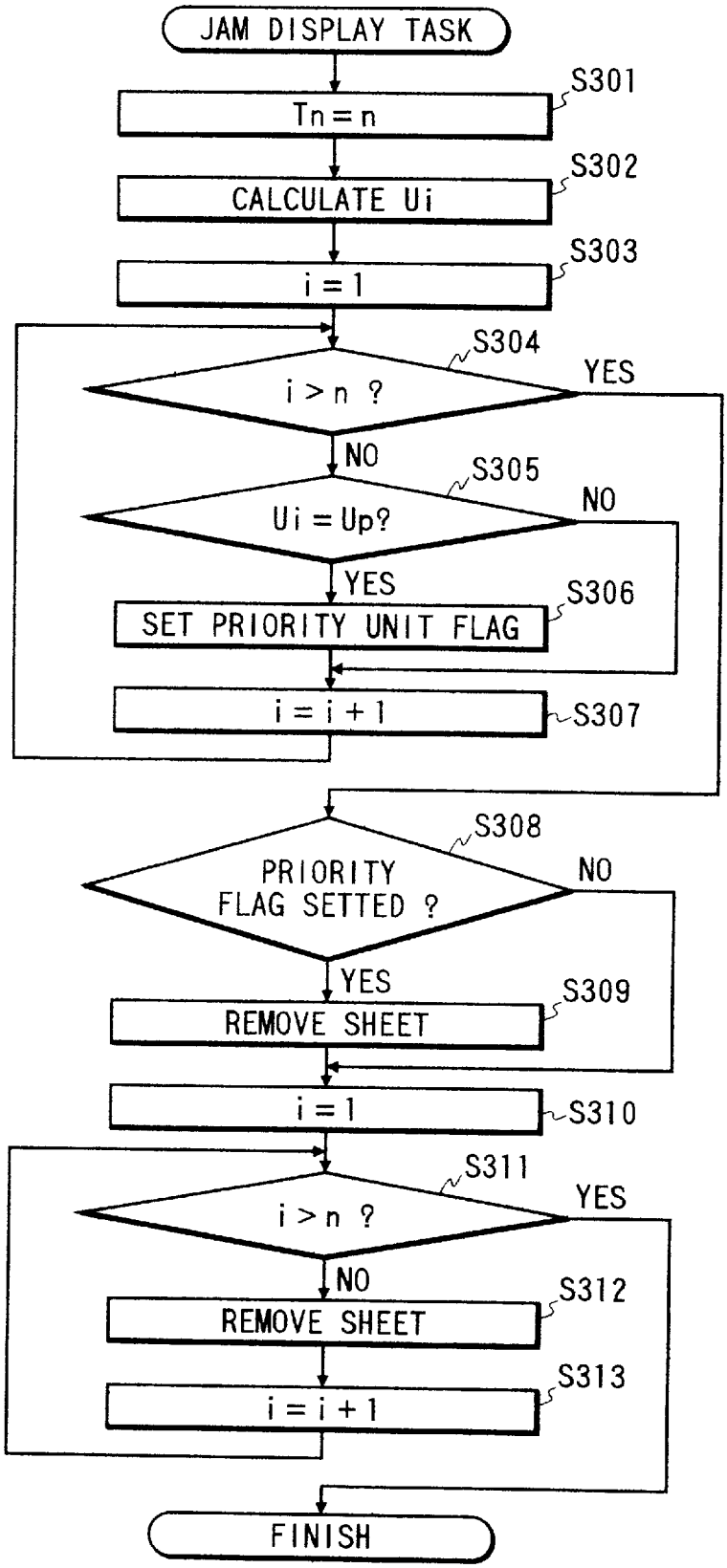
FIG. 10 is a flow chart showing control of jam display task.

Next, display control for displaying information on the operation panel 200 if the sheet S is jammed in the sheet convey path will be explained. FIG. 10 is a flow chart showing control of jam display task. If the sheet S is jammed in the sheet convey path, the jam display task is started. First of all, the number n of sheets S remaining in the sheet convey path of the image forming apparatus portion 3 (excluding the sheets normally contained in the sheet supply cassette units 304 to 307) is calculated on the basis of the above-mentioned sheet supply task information, thereby determining the number Tn (n times) of sheet removal tasks regarding the jam treatment (step S301).

Then, a unit number Ui of the unit to which the stopped sheet S belongs is calculated (step S302). The unit number Ui comprises first and second unit numbers which determine the priority order for effecting the jam treatment even if the sheet S is stopped between two adjacent units for any compelling reason. For example, regarding the sheet S stopped immediately in front of the pair of regist rollers 13, the right upper door unit 311 shown in FIG. 6 is indicated by the first unit number which is the priority order for effecting the jam treatment and the fixing convey unit 301 is indicating by second unit number which is the post order for effecting the jam treatment. That is to say, by commanding the operator to firstly effect the jam treatment regarding the unit indicated by the first unit number, the jammed sheet S can be removed easily and efficiently.

Then, it is judged whether there is the priority unit Up. This is preferable when the sheet S is damaged so long as the sheet is not removed from the priority unit Up or when the stop position of the jammed sheet S cannot be judged correctly or when the sheet S is stopped between two adjacent units for any compelling reason.

First of all, the temporary variable i for counting the removal number n of the sheets remaining in the sheet convey path of the image forming apparatus portion 3 is set to "1" (step S303), and it is judged whether the temporary variable i reaches the removal number n (step S304). If not, it is judged whether there is the predetermined priority unit Up (step S305). If there is the priority unit Up, a priority unit flag is set (step S306), and the temporary variable i is increased by 1 increment (step S307). Then, the sheet removal task is repeated by Tn times corresponding to the removal number n. If the priority unit flag is set (step S308), the sheet removal treatment (described later) is carried out (step S309), thereby removing the sheets to be removed in accordance with priority order.

Then, the similar removal treatment is repeated regarding the remaining sheets. First of all, the temporary variable i is set to "1" (step S310), and it is judged whether the temporary variable i reaches the removal number n (step S311). If not, the sheet removal treatment (described later) is carried out (step S312), the temporary variable i is increased by 1 increment (step S313), and the sheet removal task is repeated by Tn times corresponding to the removal number n. Then, the sheet removal task control is finished.

Figure 11:
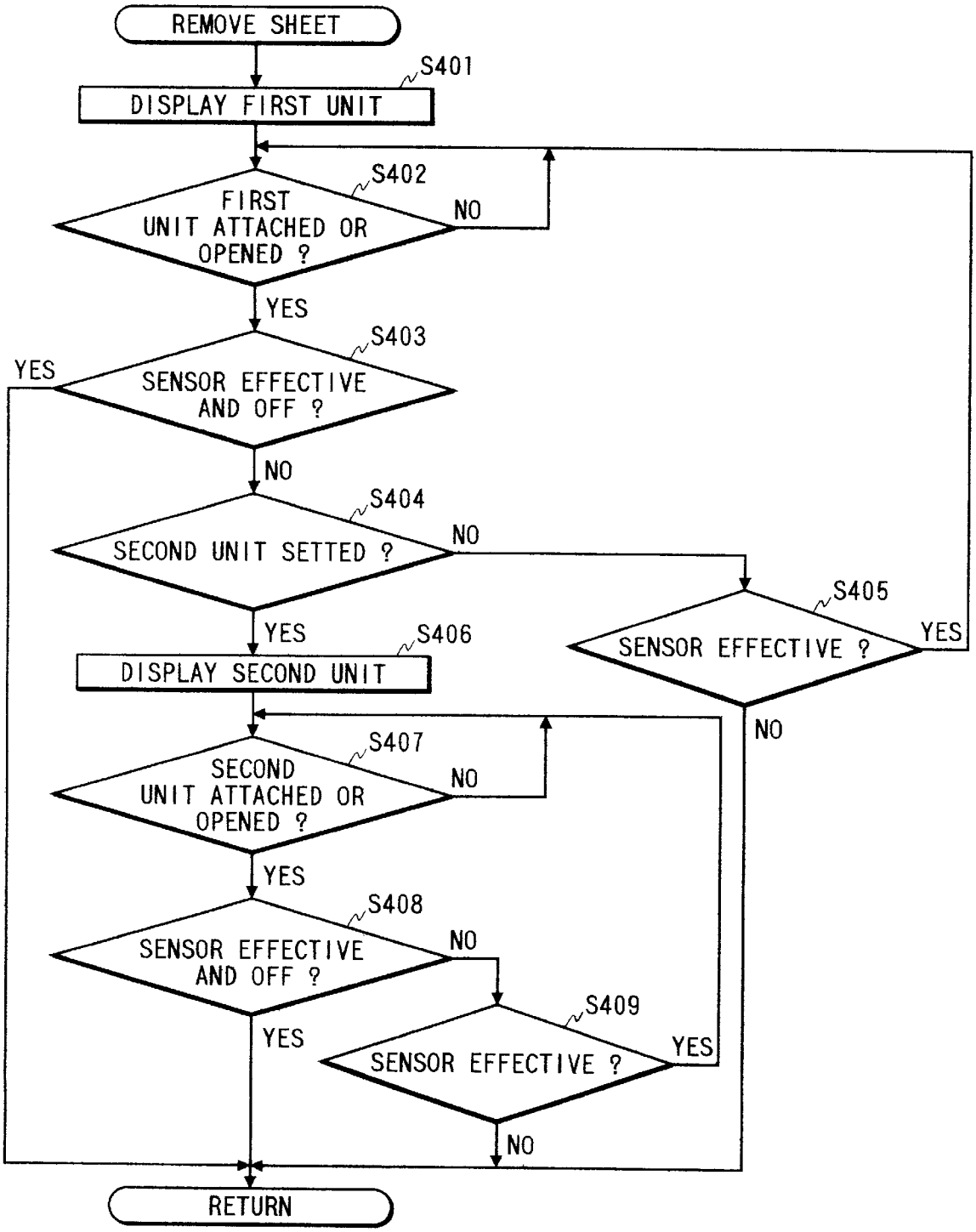
FIG. 11 is a flow chart showing control of sheet removing treatment.

Next, the sheet removal treatment will be explained. FIG. 11 is a flow chart showing control of the sheet removal treatment. The display order of the units (for which the jam treatment is to be effected) recognized by the unit recognizing means is determined by the display order determining means of the control device 100, and the display control means causes the display means to display the jam treatment procedure on the message display 615.

First of all, the display for demanding the jam treatment of the unit indicated by the first unit number (priority unit) is displayed on the message display (LCD) 615 of the operation panel 200 (step S401), and, it is judged whether the first unit is dismounted or opened by the operator (step S402). When the first unit is dismounted or opened, it is judged whether the sheet S can be detected by the sensor of the first unit, i.e., whether the sheet is detected by the sensor before the first unit is dismounted or opened and the sensor is turned OFF after the first unit is dismounted or opened (step S403).

If the sensor is effective and is turned OFF, it is recognized that the sheet is removed by the operator, thereby finishing the sheet removal treatment control. To the contrary, in the other conditions, i.e., if the sensor is not effective or/and is turned ON, it is recognized that the sheet removal is not completed. In this case, in a step S404, it is judged whether the second unit number (post treatment order) is set (step S404). If the second unit number is not set, it is judged whether the sensor is effective (step S405). If the sensor is effective, it is judged again whether the first unit is dismounted or opened (step S402).

On the other hand, if the second unit number is set, the display for demanding the jam treatment of the unit indicated by the second unit number is displayed on the message display 615 of the operation panel 200 (step S406), and, it is judged whether the second unit is dismounted or opened by the operator (step S407). When the second unit is dismounted or opened, it is judged whether the sheet is detected by the sensor of the second unit and the sensor is turned OFF after the first unit is dismounted or opened (step S408).

If the sensor is effective and is turned OFF, similar to the above, it is recognized that the removal of the sheet S is completed, thereby finishing the sheet removal treatment control. To the contrary, in the other conditions, i.e., if the sensor is not effective or/and is turned ON, it is recognized that the sheet removal is not completed. In this case, in a step S409, it is judged whether the sensor is effective. If the sensor is not effective, it is recognized that the removal of the sheet S is completed, thereby finishing the sheet removal treatment control. On the other hand, if the sensor is effective, it is judged again whether the second unit is dismounted or opened (step S407).

Figure 12:
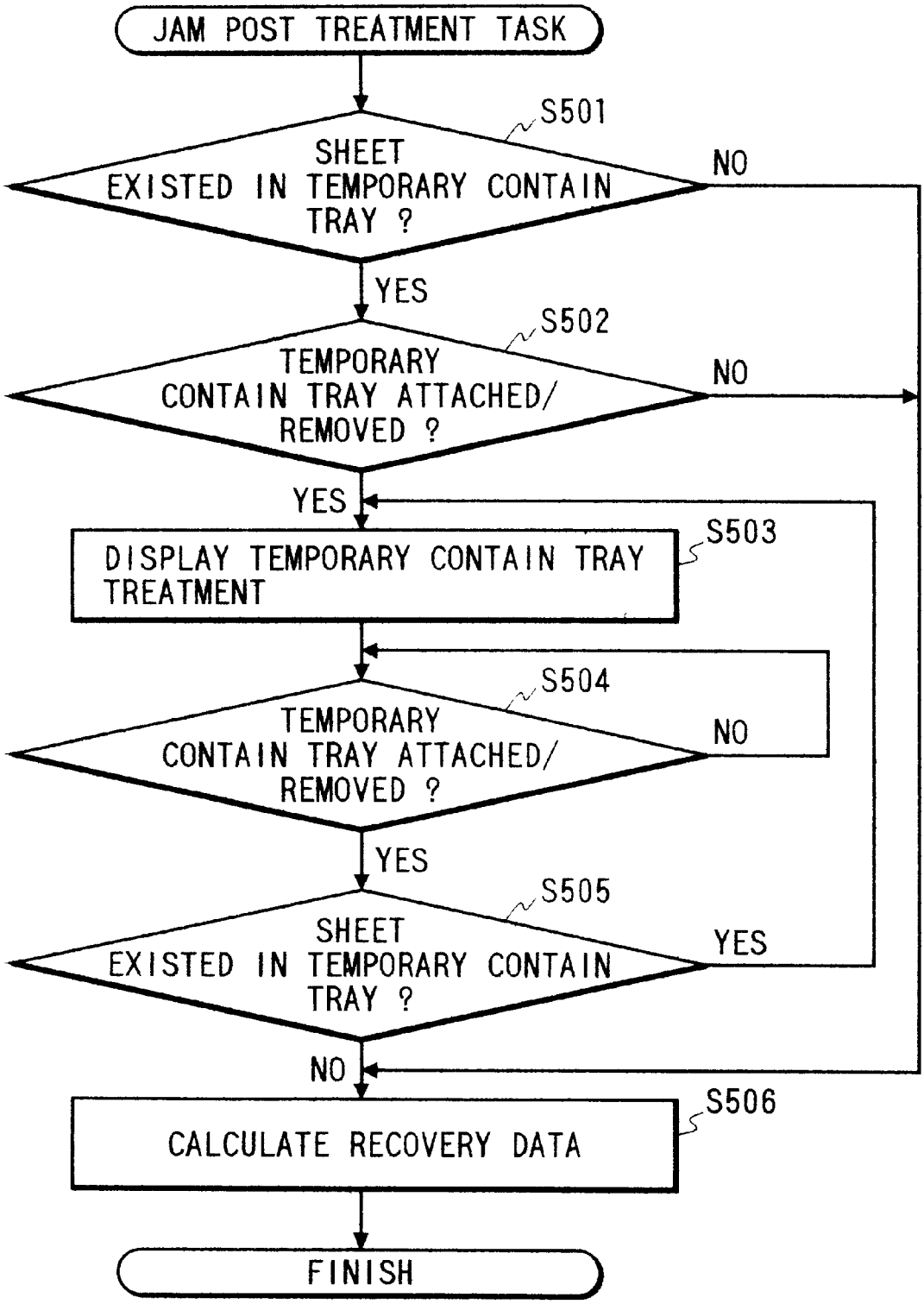
FIG. 12 is a flow chart showing control of jam post treatment task.

Next, control of jam post treatment task for re-using the sheets S remaining in the temporary contain tray 23 when the sheet jam occurs will be explained. FIG. 12 is a flow chart showing the jam post treatment task. When it is recognized that the sheets S are remaining in the temporary contain tray 23 by the unit recognizing means, the display control means of the control device 100 causes the display means to display the treatment of the sheets S remaining in the temporary contain tray 23 on the message display 615.

First of all, it is judged whether the sheets S are remaining in the temporary contain tray 23 (step S501). If there is no sheet in the temporary contain tray 23, the normal recovery data is calculated (step S506). On the other hand, if any sheet S is remaining in the temporary contain tray 23, it is judged whether the temporary contain tray 23 is mounted or dismounted after the entire jam treatment is completed (step S502). If the temporary contain tray 23 is mounted or dismounted, the treatment for the temporary contain tray 23 is displayed (step S503). Then, it is judged whether the temporary contain tray 23 is mounted or dismounted by the operator (step S504). After the temporary contain tray 23 is mounted or dismounted, the treatment display is repeated until there is no sheet in the temporary contain tray 23 (step S505). After the sheet is completely removed from the temporary contain tray 23, the recovery data is calculated (step S506), and then the control of the jam post treatment task is finished. If the temporary contain tray 23 is mounted or dismounted by the operator even when the sheets S in the temporary contain tray 23 can be re-used, the treatment display is displayed as "non re-used".

Figure 13:
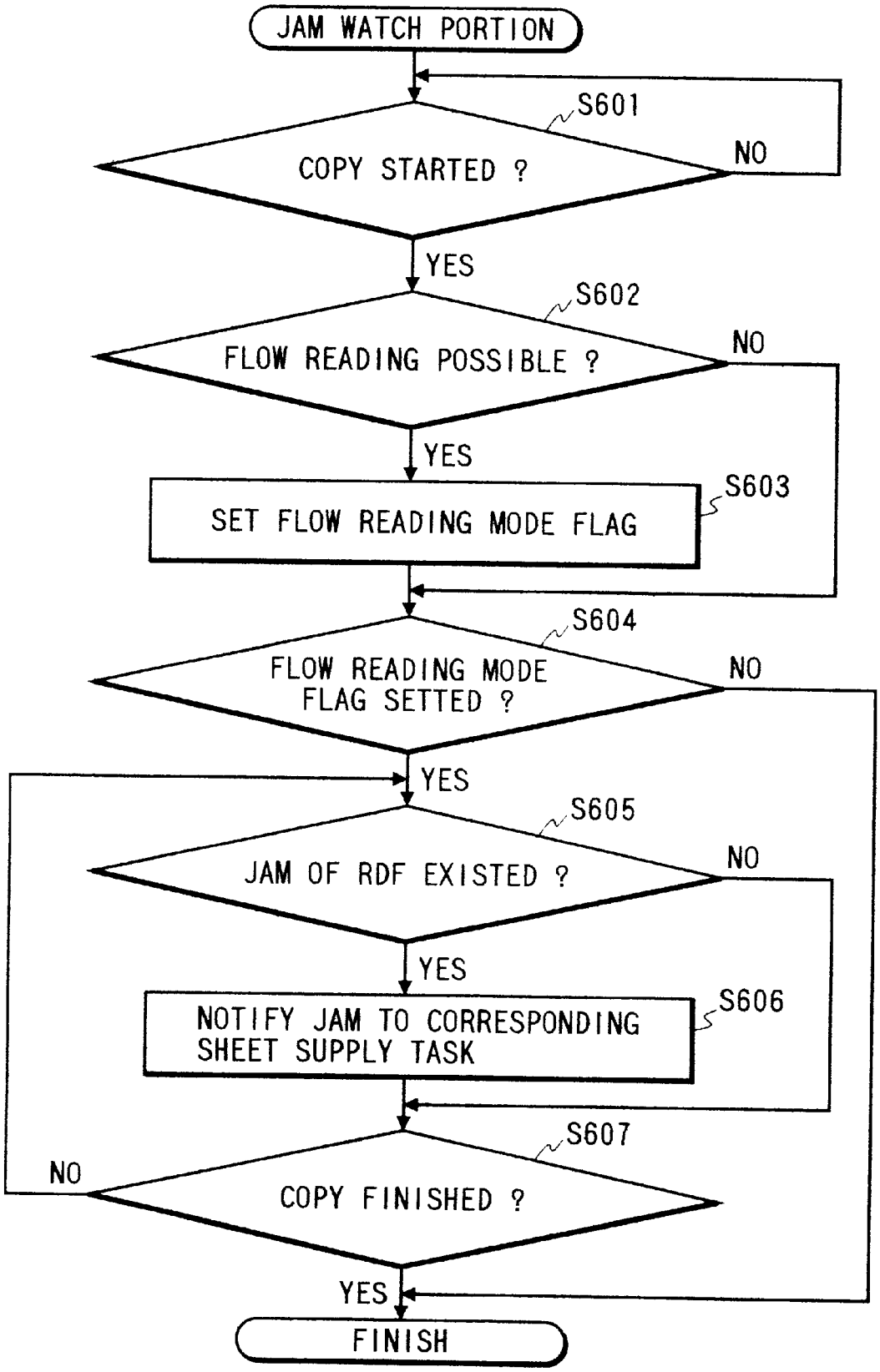
FIG. 13 is a flow chart showing control of jam watch.

Next, control of a jam watch portion for monitoring or watching the jam occurrence will be explained, particularly, in connection with the flow reading mode. FIG. 13 is a flow chart showing the control of the jam watch. First of all, it is judged whether the copy start key 605 is depressed (step S601). When the copy start key 605 is depressed, it is judged whether the flow reading mode can be adopted or not on the basis of the original size and the copy magnification (step S602).

If the flow reading is possible, a flow reading mode flag is set (step S603). If the flow reading mode flag is set (step S604), the jam occurrence in the circulating automatic original feeding apparatus (RDF) 2 is monitored (step S605). If the sheet jam occurs in the automatic original feeding apparatus, the fact that the jam occurred is notified to the corresponding sheet supply task (in which the image is being formed) (step S606), and the monitoring is continued until the copy is finished (step S607). When the copy is finished, the jam monitoring operation of the jam watch portion is finished. That is to say, in the flow reading mode, if the sheet jam occurs in the automatic original feeding apparatus 2, the sheet S (being imaged) corresponding to the jammed original is forcibly stopped, thereby preventing the non-imaged sheet from being discharged out of the copying machine.

According to the present invention, since the sheet conveying apparatus has the above-mentioned construction and function, if the sheet is jammed, by stopping the sheet at a position where the jammed sheet can easily be removed, it is possible to display the treatment procedure for the optimum jam treatment. Further, since the stop position of the sheet in the sheet convey path is recognized by the position counter, the accuracy of the recognition of the jam treatment position is improved, thereby removing the jammed sheet positively and efficiently. In addition, in the image forming apparatus having such a sheet conveying apparatus, the image can be formed on the sheet conveyed by utilizing the advantage of the sheet conveying apparatus, and, if the sheet is jammed in the image forming apparatus, the jammed sheet can be removed positively and efficiently.

As mentioned above, while the image is being formed under the flow reading control, if the abnormality in the original conveyance is detected by the original supply abnormality detection means, by forcibly stopping the sheet (being imaged), it is possible to prevent the mixture of the imaged sheets and the non-imaged sheets.

What is claimed is:

1. A sheet conveying apparatus comprising:

sheet convey means disposed along a sheet convey path for conveying a sheet through plural convey units;

sheet detection means for detecting a passage of the sheet at a predetermined position in the sheet convey path;

convey abnormality detecting means for detecting a sheet conveyance abnormality in said sheet convey path;

a sheet position counter for counting a count value corresponding to a position of the sheet in response to a drive of said sheet convey means to recognize the position of the sheet in said sheet convey path;

sheet stop position determining means for determining an optimum stop position of the sheet in the convey units on the basis of the count value counted by said sheet position counter, when the sheet conveyance abnormality is detected by said convey abnormality detecting means; and control means for controlling the sheet convey means to stop the sheet at a position determined by said sheet stop position determining means, wherein said sheet position counter is reset from the count value counted by said sheet position counter to a value corresponding to said predetermined position when said sheet detection means detects the sheet.

2. A sheet conveying apparatus according to claim 1, wherein said control means is so designed as to successively stop sheets situated at an upstream side of the stopped sheet stopped in said sheet convey path in a sheet conveying direction, after the sheet having the convey abnormality was stopped.

3. A sheet conveying apparatus according to claim 1, wherein said sheet position counter is so designed as to recognize a position of a tip end of the sheet.

4. A sheet conveying apparatus according to claim 1, wherein said sheet convey means includes a pair of rollers, and when the sheet conveyance abnormality is detected by said convey abnormality detecting means, said control means controls said sheet convey means to stop the sheet at a predetermined position in which the sheet is nipped by said pair of rollers.

5. A sheet conveying apparatus according to claim 1, wherein one of said units is an image forming unit including an image forming means for forming an image on the sheet being conveyed by said sheet convey means, and said pair of rollers is disposed on said image forming unit.

6. A sheet conveying apparatus comprising:

sheet convey means disposed along a sheet convey path for conveying a sheet through plural convey units;

sheet detection means for detecting a passage of the sheet at a predetermined position in a sheet convey path;

convey abnormality detecting means for detecting a sheet conveyance abnormality in said sheet convey path;

a sheet position counter for counting a count value corresponding to a position of the sheet in response to a drive of said sheet convey means to recognize the position of the sheet in said sheet convey path;

recognizing means for recognizing a position of the sheet stopped in the convey path on the basis of the count value counted by said sheet position counter;

display means for displaying a treatment procedure of the sheet conveying apparatus; and control means for determining a treating order of the units on the basis of the recognition of said recognizing means, and displaying it on said display means, wherein said sheet position counter is reset from the count value counted by said sheet position counter to a value corresponding to said predetermined position when said sheet detection means detects the sheet.

7. An image forming apparatus comprising:

a sheet conveying apparatus according to claim 6;

an image forming means for forming an image on the sheet conveyed by said sheet conveying apparatus in response to an image information;

a temporary contain means for temporarily containing the sheet on which the image was formed by said image forming means; and a display control means for causing said display means to display a fact that the sheet in said temporary contain means should be treated, when said temporary contain means is mounted in a condition that an available sheet remains in said temporary contain means, after the abnormality in sheet conveyance is detected by said convey abnormality detecting means.

8. An image forming apparatus comprising:

sheet convey means disposed along a sheet convey path for conveying a sheet through plural convey units;

sheet detection means for detecting a passage of the sheet at a predetermined position in the sheet convey path;

convey abnormality detecting means for detecting a sheet conveyance abnormality in said sheet convey path;

a sheet position counter for counting a count value corresponding to a position of the sheet in response to a drive of said sheet convey means to recognize the position of the sheet in said sheet convey path;

sheet stop position determining means for determining an optimum stop position of the sheet in the convey units on the basis of the count value counted by said sheet position counter, when the sheet conveyance abnormality is detected by said convey abnormality detecting means;

control means for controlling the sheet convey means to stop the sheet at a position determined by said sheet stop position determining means, wherein said sheet position counter is reset from the count value counted by said sheet position counter to a value corresponding to said predetermined position when said sheet detecting means detects the sheet;

image forming means for forming a latent image on a photosensitive member by exposing an original by exposure means and for forming an image on the sheet conveyed by said sheet convey means, an original convey means for conveying the original at a predetermined speed, a fixing means for fixing the image formed by said exposure means at a predetermined position; and original convey exposure control means for conveying the original at the predetermined speed by said original convey means while fixing said exposure means at the predetermined position to expose the original conveyed by said original convey means by said exposure means, and an original convey abnormality detection means for detecting the abnormality in said original convey means, wherein while the image formation is being effected under the control of said original convey exposure control means, if the original conveyance abnormality is detected by said original convey abnormality detection means, the sheet on which the image is being formed is forcibly stopped by said control means.

9. A sheet conveying apparatus according to claim 8, wherein said sheet convey means includes a pair of registering rollers, and when the sheet conveyance abnormality is detected by said convey abnormality detecting means, said control means controls said sheet convey means to stop the sheet at a predetermined position in which the sheet is nipped by the pair of registering rollers being disposed at one of said convey units and located upstream a photosensitive drum, and being drawable integral with said one of the convey units.

10. A sheet conveying apparatus according to claim 5, wherein said pair of rollers send out the sheet to said image forming means in a timing depending upon an image formation start timing of said image forming means.

11. A sheet conveying apparatus according to claim 10, wherein said image forming means comprises a toner image bearing member from which a toner image is transferred onto the sheet, and a fixing means for fixing the toner image transferred to the sheet from said toner image bearing member to said sheet.

12. A sheet conveying apparatus according to claim 11, wherein said control means controls said convey means in such a manner that, when the abnormality in sheet conveyance is detected by said abnormality detection means, the sheet is stopped in a condition that an end of the sheet alone is pinched by said pair of rollers, and stops said fixing means before the sheet reaches said fixing means.

13. A sheet conveying apparatus according to claim 11, wherein, in the case where a sheet having a maximum length in a conveying direction among available sheets is conveyed, a distance between said pair of rollers and said fixing means is selected so that, when the abnormality in sheet conveyance is detected by said convey abnormality detecting means, a position of a tip end of the sheet stopped in a condition that the end of the sheet alone is pinched by said pair of rollers is situated at an upstream side of said fixing means.

14. A sheet conveying apparatus according to claim 10, wherein said pair of rollers are disposed an upstream end of said image forming unit.

* * * * *

UNITED STATES PATENT AND TRADEMARK OFFICE

CERTIFICATE OF CORRECTION

PATENT NO. : 6,011,936

DATED : January 4, 2000

INVENTOR(S): TOKUHARU KANEKO

It is certified that error appears in the above-identified patent and that said Letters Patent is hereby corrected as shown below:

In the Drawings:

SHEET 10:

Figure 10, "SETTED" should read --SET--.

SHEET 11:

Figure 11, "SETTED" should read --SET--.

SHEET 13:

Figure 13, "SETTED" should read --SET--.

COLUMN 1:

Line 12, "motor" should read --a motor--;
Line 20, "has" should read --have--;
Line 51, "a" should read --an--; and
Line 61, "sheet" should read --a sheet--.

COLUMN 4:

Line 5, "cassette" should read --cassettes--;
Line 6, "lid" should read --lld--; and
Line 7, "cassette" (both occurrences) should read --cassettes--.

COLUMN 5:

Line 58, "elements" should read --element--.

UNITED STATES PATENT AND TRADEMARK OFFICE

CERTIFICATE OF CORRECTION

PATENT NO. : 6,011,936

DATED : January 4, 2000

INVENTOR(S): TOKUHARU KANEKO

It is certified that error appears in the above-identified patent and that said Letters Patent is hereby corrected as shown below:

COLUMN 7:
Line 19, "in" should read --is in--.

COLUMN 8:
Line 4, "the fact that" should be deleted;
Line 41, "even" should read --and even--; and
Line 46, "surely be" should read --sure to be--.

COLUMN 9:
Line 38, "by" should read --by a--.

COLUMN 13:
Line 9, "an" should be deleted.

UNITED STATES PATENT AND TRADEMARK OFFICE

CERTIFICATE OF CORRECTION

PATENT NO. : 6,011,936

DATED : January 4, 2000

INVENTOR(S): TOKUHARU KANEKO

It is certified that error appears in the above-identified patent and that said Letters Patent is hereby corrected as shown below:

COLUMN 14:

Line 52, "an" should read --to an--.

Signed and Sealed this

Nineteenth Day of December, 2000

*Attest:*

Q. TODD DICKINSON

*Attesting Officer*

*Commissioner of Patents and Trademarks*